United States Patent [19]

Benz

[11] Patent Number: 4,627,260

[45] Date of Patent: Dec. 9, 1986

[54] ROLLING STAND WITH AXIALLY SHIFTABLE ROLLS

[75] Inventor: Willi Benz, Neuss, Fed. Rep. of Germany

[73] Assignee: SMS Sloemann Siegmag AG, Dusseldorf, Fed. Rep. of Germany

[21] Appl. No.: 631,916

[22] Filed: Jul. 18, 1984

[30] Foreign Application Priority Data

Jul. 18, 1983 [DE] Fed. Rep. of Germany ..... 3325823

[51] Int. Cl.[4] ..... B21B 1/38; B21B 31/18

[52] U.S. Cl. ..... 72/247; 72/236; 72/250; 72/366

[58] Field of Search ..... 72/247, 365, 366, 250, 72/236, 199

[56] References Cited

U.S. PATENT DOCUMENTS

| | | | |
|---|---|---|---|
| 2,047,883 | 7/1936 | Phillips | 72/247 |
| 3,857,268 | 12/1974 | Kajiwaka | 72/247 |
| 3,902,345 | 9/1975 | Shida | 72/247 X |
| 4,162,627 | 7/1979 | Shida et al. | 72/247 |

FOREIGN PATENT DOCUMENTS

| | | | |
|---|---|---|---|
| 1037804 | 2/1959 | Fed. Rep. of Germany . | |
| 3245090 | 6/1984 | Fed. Rep. of Germany . | |
| 0073403 | 6/1980 | Japan | 72/250 |
| 0055103 | 4/1983 | Japan | 72/199 |
| 0068403 | 4/1983 | Japan | 72/199 |
| 2119968 | 11/1983 | United Kingdom . | |

*Primary Examiner*—Francis S. Husar
*Assistant Examiner*—Steve Katz
*Attorney, Agent, or Firm*—Karl F. Ross; Herbert Dubno

[57] ABSTRACT

A roll stand has a support frame, a pair of similar small-diameter working rolls rotatable about respective vertically spaced axes and defining a workpiece nip receiving a workpiece to be rolled, and a pair of similar large-diameter backup rolls rotatable about respective axes vertically flanking the working-roll axes and each bearing vertically on the respective working roll. These working rolls have ends and each have therebetween an effective axial length equal to at least 1.3 times the effective axial length of the respective backup rolls. Actuators are connected to the working rolls for displacing same axially relative to the backup rolls through an axial distance equal to about their own effective axial lengths between end positions each engaging only about half of the respective backup roll. A selector feeds to and through the stand a group of strips comprised generally of pairs of strips wherein the combined width of the strips of each pair is generally equal to the working-roll width. A controller is connected to the actuator for positioning the working rolls of the stand with their ends at one edge of one of the workpieces of each pair and at the opposite edge of the other workpiece of the pair.

7 Claims, 5 Drawing Figures

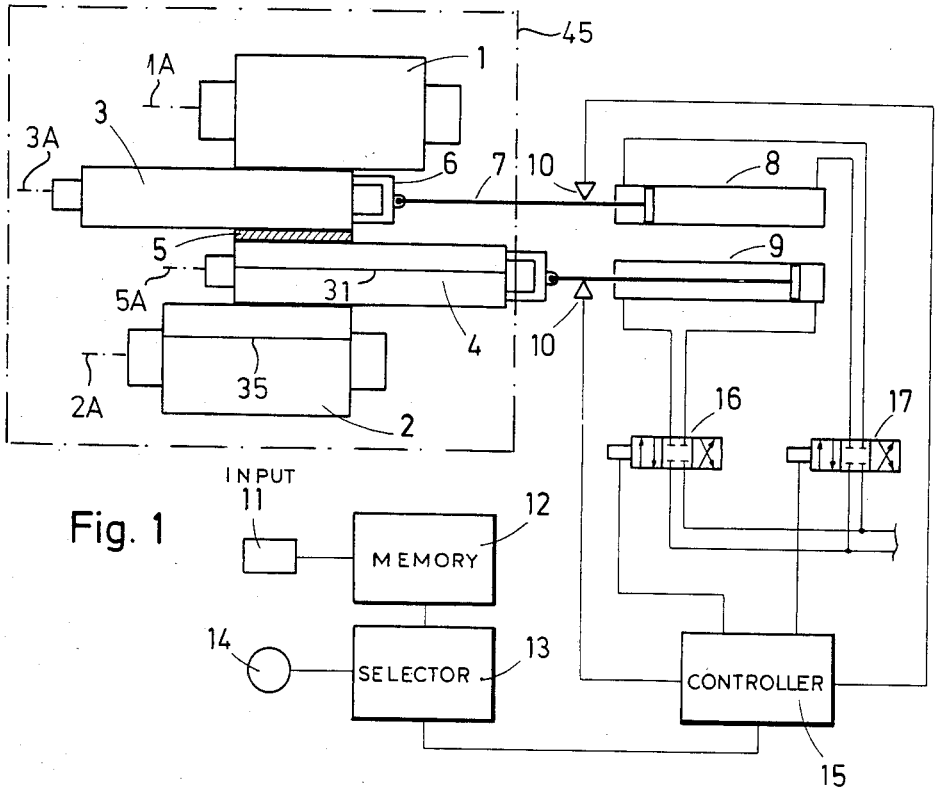
Fig. 1
Fig. 2
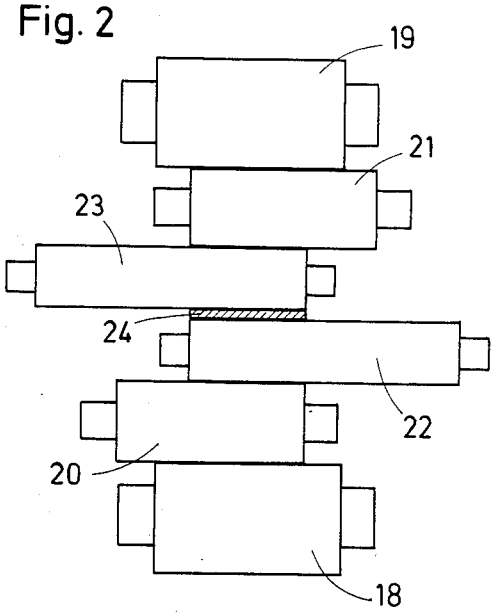

ROLLING STAND WITH AXIALLY SHIFTABLE ROLLS

FIELD OF THE INVENTION

The present invention relates to the rolling of metallic strip. More particularly this invention concerns a roll stand and a method of operating same.

BACKGROUND OF THE INVENTION

A standard cold-rolling stand has a support frame, a pair of small-diameter working rolls rotatable about respective horizontal, parallel, and vertically spaced axes defining a workpiece nip, and a pair of large-diameter backup rolls rotatable about respective axes parallel to and vertically flanking the working-roll axes. Each backup roll bears vertically on the respective working roll and the rolls of each pair are counterrotated to draw an elongated workpiece of predetermined maximum width generally perpendicular to the plane or planes of the roll axes through the nip. The rolls are pressed vertically toward the nip to compress and deform the workpiece in the nip. Such an arrangement may further have outer backup rolls engaging the already described inner backup rolls.

It is also known to axially shift the working rolls in such an arrangement in order to intensify the rolling action by varying the nip length. Since the workpiece width is rarely less than half of the backup roll width, this can be done with working and backup rolls of virtually the same length. Such a procedure leads however to rapid wear of the working rolls. Accordingly it is standard practice to schedule the various runs that are to be done so as to start with a run of medium width measured parallel to the roll axes and perpendicular to the strip travel direction and then to roll strips of increasingly greater width to the maximum width the stand can roll, then decrease the strip width gradually to a width substantially smaller than the starting width. Such a procedure rapidly heats up the rolls and then effectively pulls the workpiece back from the worn ends of these rolls, as it is the workpiece edges that subject the rolls to their principal material-removing wear.

With such an arrangement the central region of the working rolls remains relatively unused. Thus when the rolls must be returned to perfect cylindrical shape, which is normally done by grinding or otherwise machining them down, this unworn central part must be cut back, even though it is virtually unworn, to redress the roll. In systems with axially shiftable working rolls, such wear concentrated even in the end regions is very pronounced. Thus such a prior-art roll stand is often down for work in the rolls, this working being aggravated by having to cut down an unworn roll part.

It has been suggested to oscillate the working rolls axially slightly during a run to spread out the workpiece-edge wear. Although this does somewhat lessen the wear in any one spot, it still leaves all the wear at the roll ends.

OBJECTS OF THE INVENTION

It is therefore an object of the present invention to provide an improved roll stand and method of operating same.

Another object is the provision of such a roll stand and method of operating same which overcome the above-given disadvantages, that is which distribute the wear evenly over the axially extending width of the working rolls.

SUMMARY OF THE INVENTION

A roll stand according to the invention has a support frame, a pair of similar small-diameter working rolls rotatable about respective vertically spaced axes and defining a workpiece nip receiving a workpiece to be rolled, and a pair of similar large-diameter backup rolls rotatable about respective axes vertically flanking the working-roll axes and each bearing vertically on the respective working roll. These working rolls have ends and each have therebetween an effective axial length equal to at least 1.3 times the effective axial length of the respective backup rolls. Actuators are connected to the working rolls for displacing same axially relative to the backup rolls through an axial distance equal to about their own effective axial lengths between end positions each engaging only about half of the respective backup roll. A selector feeds to and through the stand a group of strips comprised generally of pairs of strips wherein the combined width of the strips of each pair is generally equal to the working-roll width. A controller is connected to the actuator means for positioning the working rolls of the stand with their ends at one edge of one of the workpieces of each pair and at the opposite edge of the other workpiece of the pair.

Thus with this system the wear, which is concentrated on the working rolls at the regions that contact the workpiece edges, is spread out over virtually the entire axial length of the working roll. In fact according to this invention if a given lot of workpieces is all generally of the same size, they can be efficiently rolled on working rolls of a width twice this size, so that by using alternate sides the rolls would be evenly worn.

According to another feature of this invention the selector is a computer having a memory in which data about available strips to be rolled is stored. The memory also stores data about the amount of friction a given lot of the material will subject the working rolls to, the length of each strip, the amount of rolling reduction each strip is to have, and the resistance to deformation of the strip. Thus a friction factor can be made which, with the strip width, is all that is needed to be known about a given strip or lot.

The method of this invention therefore comprises the steps of selecting from a group of to-be-rolled strips a subgroup of strips comprised generally of pairs of strips wherein the combined width of the strips of each pair is generally equal to the working-roll width, feeding this subgroup to and through the stand the workpieces of the subgroup with the workpiece edges directed axially of the rolls, and axially positioning the working rolls of the stand such that their ends are at one edge of one of the workpieces of each pair and at the opposite edge of the other workpiece of the pair. Although the working rolls can be shifted in the same direction, normally according to this invention they are oppositely axially shifted between succeeding strips.

The actuator means axially reciprocate the working rolls, either during a roll or between rolls. The rolls are dressed after the subgroup is all rolled, and in fact the composition of the subgroup is specifically calculated that when the entire planned batch of strips has been rolled, it is time to resurface the working rolls.

As mentioned above, the selection of the subgroup is based on the strip width and the amount of wear the strip would subject the working rolls to. This wear is actually a function of the length, and resistance to deformation, as well as on the amount the strip is to be reduced in thickness by rolling, and the rolling speed, as well as on some other factors. The strips of the subgroup are rolled according to this invention more toward the center than toward the edges of the rolls, with the outer strip edges moving inward from the working-roll ends, as the entire batch is rolled.

DESCRIPTION OF THE DRAWING

The above and other features and advantages will become more readily apparent from the following, reference being made to the accompanying drawing in which:

FIG. 1. is a mainly schematic view of a four-high rolling apparatus according to this invention;

FIG. 2 is a diagrammatic end view of a six-high roll stand according to the invention;

SPECIFIC DESCRIPTION

Figure 3:
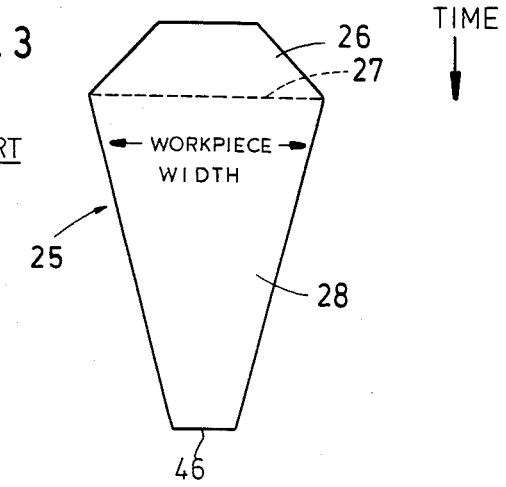
Fig. 3 PRIOR ART
FIG. 3 is a diagrammatic view illustrating operation of the prior-art roll stands.

As seen in FIG. 1 a roll stand has a stand or frame indicated schematically as dot-dash box 45 and supporting two large-diameter backup rolls 1 and 2 centered on respective parallel axes 1A and 2A and two small-diameter working rolls 3 and 4 centered on parallel axes 3A and 4A parallel to the axes 1A and 2A. The rolls 1 and 2 bear respectively downward and upward on the rolls 3 and 4 which in turn bear downward and upward on the upper and lower surfaces of a strip workpiece 5 received in the nip defined between these rolls 3 and 4.

According to this invention the working rolls 3 and 4 are of a length 31 that is equal to at least 1.3 times the length 35 of the backup rolls 1 and 2. These working rolls 3 and 4 have ends mounted in journal blocks 6 connected to piston rods 7 of respective double-acting hydraulic rams 8 and 9 capable of axially shifting the respective rolls 3 and 4 in each direction from a central position through axial strokes equal to about half the length 35. Thus each working roll 3, 4 can move through an axial stroke about equal to its length 31, from a position only bearing with its one half on the respective normally oppositely shifted backup roll to a position bearing with only its other half thereon, in a complementarily shifted position thereof.

FIG. 2 shows a six-high stand with working rolls 22 and 23 substantially identical to the rolls 3 and 4 and flanking a workpiece 24. These working rolls 22 and 23 are flanked by inner backup rolls 20 and 21 of the same length as the rolls 1 and 2, and flanked in turn by outer backup rolls 18 and 19. This arrangement can be operated identically to that of FIG. 1, and can even have shiftable rolls 20 and 21.

FIG. 3 illustrates in exaggerated fashion not to scale the standard method of eliminating the effect of roll wear in a prior-art system. In this drawing the coffin-shaped FIG. 25 has a horizontal width which represents the widths of the various runs of strip steel and a vertical dimension which illustrates the dimension of time, starting from the top. Thus to start with a narrow band width is employed, as shown in field 26 increasing to a maximum width 27. Then the field 28 illustrates how the width slowly decreases to a minimum width 46 at the bottom that is even narrower than the starting width.

The increasing width of the first field 26 is employed so that the rolls are warmed up rapidly and assume the shapes that they will have during subsequent operation, that is when fairly hot. The decreasing width of the second field 28 is used to keep the workpiece out of contact with the worn edge regions of the rolls. Thus each run is somewhat narrower than the previous run so that the roll wear, which is mainly at the workpiece edges, is constantly avoided. As described above, it is obvious that this arrangement leaves the working rolls each with a central region having the width 46 that is substantially unused.

In accordance with the present invention workpieces are selected and processed in accordance with the principles illustrated by the two complementary right trapezoidal fields 29 and 30 of FIG. 4, which once again is purely illustrative and not to scale. Thus workpieces are processed having maximum widths 32 or 35 and minimum widths 33 or 34. The maximum widths 32 and 35 are identical and, as mentioned above, equal to the axial length of the workpiece-engaging center portion of each backup roll 1 or 2 or inner backup roll 20 or 21. Either minimum width 33 or 34 equals, with the respective maximum width 35 or 32, slightly less than the axial length 31 of the workpiece-engaging center portion of each working roll 3 or 4 and is also equal to about half the respective maximum width 35 or 32.

All of the strips or strip runs that form the field 29 are rolled and those of the other field 30 are rolled and each group of workpieces is only rolled on about half of the working rolls. To start with the widest and narrowest workpieces are normally rolled, with shifting of the rolls axially oppositely away from each other each time workpiece width changes through a distance equal to half the difference between the width of the present workpiece and that of the just-rolled workpiece. In this manner each workpiece is rolled on a portion of the working rolls that is centered within the region that engaged the previous workpiece, so that the worn regions created by the previous workpiece are out of contact with the current workpiece. It is also possible to do the run corresponding to field 29 and then that of field 30, but it is preferred to work in pairs each formed by one workpiece or lot of the one field 29 and the workpiece at the same level in field 30.

Thus it is possible according to this invention to mix up the various lots, so long as the rolls are positioned appropriately, rolling a workpiece from the batch of field 29 and then a workpiece from the same level of the batch of field 30. Of course, the mill rarely has a stock of workpieces to be rolled whose widths vary perfectly uniformly within the given range, and in fact it might be necessary to take one size well out of turn. Even so, the principles of this invention are in part based on selecting from the materials available a group of workpieces that will ensure even working-roll wear, and rolling those materials on a given pair of extra-long working rolls so as to maximize the service life of same. This is accomplished using workpieces that are at most three-quarters the width of the working rolls, as opposed to standard workpieces whose widths can vary from half to the full working-roll width.

Since the workpieces are fed to the working rolls centered in the roll stand so that the strips of the batch of field 29 have their left-hand roll edges level with the left-hand workpiece edge and the working rolls are appropriately positioned for the workpiece width. For workpieces from the batch of field 30 the right-hand roll edges are level with the right-hand workpiece edge. The working rolls can be shifted oppositely as shown in FIGS. 1 and 2 or in the same direction to compensate for changing workpiece width.

Figure 4:
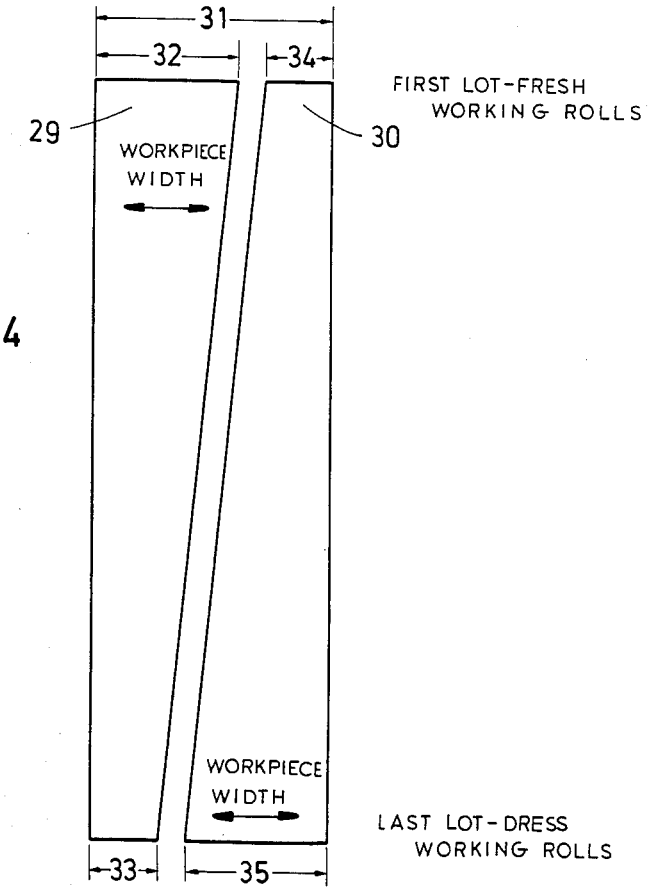
FIG. 4 is a diagrammatic view illustrating operation of the roll stand according to this invention.

The gap shown between the fields 29 and 30 of FIG. 4 ensures that wear is even even in this region which is subjected to considerable damage from the workpiece edges. The wear at the outer edges of the trapezoids is also distributed by moving the rolls axially, so that wear will be distributed evenly over the entire length of each working roll.

The method illustrated in FIG. 4 is effected according to FIG. 1 by providing valves 16 and 17 that control the cylinders 8 and 9 that axially shift the rolls 3 and 4. A controller 15 operates these valves 16 and 17 in accordance with actual-value signals received from position sensors 10 for the rolls 3 and 4, and respective set points received from a selector 13.

This selector 13 in turn receives its information from a memory 12 that takes input from a device 11 that can include a disk or card reader and/or a keyboard and/or any other suitable inputting equipment. The information held in the memory 12 includes at least the width and length of each strip workpiece available for rolling. In addition such factors as each strip's resistance to deformation, surface finish, amount of rolling compression to be subjected to, and roll speed can all be taken into account, as all these factors affect the wear of the working rolls from a given workpiece. Typically these factors and the strip length are all netted into a constant that represents wear, and this factor plus the width are available in the memory 12.

In addition to feeding a set point to the controller 15, the selector 13 indicates at 14 which of the various materials whose data are in the memory 12 should next be fed to the stand. The indication can be a simple display of the lot number of the strip to be put on the feed bridle. Thus the workpiece is selected whose width is relatively close to that just rolled or the above-defined partner thereof having a complementary width, and whose friction factor is taken into account to ensure uniform working-roll wear.

Figure 5:
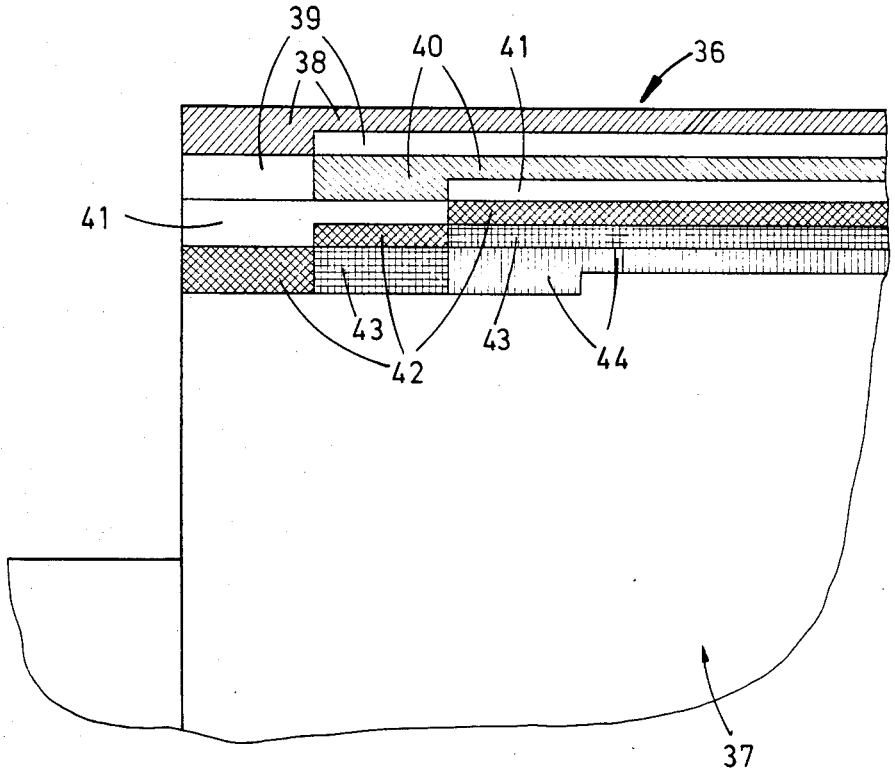
FIG. 5 is a large-scale axial section through a roll, showing the wear according to this invention.

FIG. 5 illustrates how the wear is spread out at the end 37 of a working roll 36. During the first run or pass the roll is worn away at 38, somewhat more deeply at the outer end than inward thereof. During the second run with the same size workpiece, this wear pattern is repeated, leaving the roll 37 twice as deeply eroded at its outer end as inward therefrom, as indicated at 39. For the third lot, narrower strip is rolled to wear away the roll 36 at 40, and this same band width is again used in a fourth lot to wear it away in a triple step 41 that is cut somewhat deeper as shown at 42 by a fifth run of the same width workpiece. The sixth pass is made with the same width to return the shape to a double step 43. Then a narrower workpiece is rolled to move the step in as shown at 44. Thus according to this invention a wear pattern created by as many as six different lots or runs is extremely uniform.

Once the working rolls are uniformly worn, it is possible to resurface them, either by the less popular method of layering them with new roll material and rehardening them, or by the standard procedure of grinding or cutting them down somewhat. This can be done without removing the rolls from the stand, and in fact the grinder can be mounted thereon to move along the working rolls periodically, cutting the high spots off these rolls. Feelers or reflective-type light systems can be used to determine when the rolls are too rough to use any more. In fact when there are still some fairly smooth regions left on the rolls, workpieces can be rolled that are specially selected to use these regions only.

The heating up procedure illustrated at portion 26 of FIG. 3 is not used according to this invention. Instead the rolls may be heated before mounting in the frame, and in any case the rolls are kept fairly cool during use.

Finally it is possible according to this invention to use more than two different batches of workpieces, so long as their cumulative wear is distributed over the entire working-roll length.

I claim:

1. A method of operating a roll stand comprising:

a support frame;

a pair of similar small-diameter working rolls rotatable about respective vertically spaced axes and defining a workpiece nip receiving a workpiece to be rolled;

a pair of similar large-diameter backup rolls rotatable about respective axes vertically flanking the working-roll axes and each bearing vertically on the respective working roll, the working rolls having ends and each having therebetween an effective axisl length equal to at least 1.3 times the effective axial length of the respective backup rolls; and respective actuator means connected to the working rolls for displacing same axially relative to the backup rolls through an axial distance equal to about their own effective axial lengths between end positions each engaging only about helf of the respective backup roll; the method comprising the steps of:

selecting from a group of to-be-rolled strips a subgroup of strips comprised generally of pairs of complementarily width-matched strips wherein the combined width of the strips of each pair is generally equal to the working-roll width;

feeding to and through the stand the workpieces of the subgroup with the workpiece edges directed axially of the rolls; and axially positioning the working rolls of the stand such that their ends are axially oppositely offset at one edge of one of the workpieces of each pair and so that the ends are axially oppositely offset and at the opposite edge of the other workpiece of the respective pair.

2. The operating method defined in claim 1, further comprising the step of axially oppositely shifting the working rolls between succeeding strips.

3. The operating method defined in claim 1, further comprising the step of axially reciprocating the working rolls.

4. The operating method defined in claim 1, further comprising the steps of:

dressing the rolls after the subgroup is all rolled.

5. The operating method defined in claim 1, further comprising the step of basing the selection of the subgroup on the strip width and the amount of wear the strip would subject the working rolls to.

6. The operating method defined in claim 1, further comprising the step, as the subgroup is rolled, of rolling the strips more toward the center than toward the edges of the rolls, with the outer strip edges moving inward from the working-roll ends.

7. The operating method defined in claim 1, further comprising the step of basing the selection of the subgroup on the strip width, length, and resistance to deformation, as well as on the amount the strip is to be reduced in thickness by rolling, and the rolling speed.

* * * * *